US009856433B2

(12) United States Patent
Kool et al.

(10) Patent No.: US 9,856,433 B2
(45) Date of Patent: Jan. 2, 2018

(54) LOW-LEAD DRY FILM LUBRICANT COMPOSITION

(71) Applicant: GENERAL ELECTRIC COMPANY, Schenectady, NY (US)

(72) Inventors: Lawrence Bernard Kool, Clifton Park, NY (US); Robert William Bruce, Loveland, OH (US)

(73) Assignee: General Electric Company, Niskayuna, NY (US)

( * ) Notice: Subject to any disclaimer, the term of this patent is extended or adjusted under 35 U.S.C. 154(b) by 9 days.

(21) Appl. No.: 14/797,810

(22) Filed: Jul. 13, 2015

(65) Prior Publication Data

US 2017/0015932 A1 Jan. 19, 2017

(51) Int. Cl.
*C10M 169/04* (2006.01)

(52) U.S. Cl.
CPC .... *C10M 169/04* (2013.01); *C10M 2201/053* (2013.01); *C10M 2201/066* (2013.01); *C10M 2201/0663* (2013.01); *C10M 2209/1033* (2013.01); *C10M 2209/1085* (2013.01); *C10N 2240/121* (2013.01); *C10N 2250/14* (2013.01)

(58) Field of Classification Search
CPC ..... C10M 169/04; C10M 2209/1085; C10M 2201/0663; C10M 2201/066; C10M 2201/053; C10M 2209/1033; C10N 2250/14; C10N 2240/121
See application file for complete search history.

(56) References Cited

U.S. PATENT DOCUMENTS

| | | | | |
|---|---|---|---|---|
| 7,516,547 | B2 | 4/2009 | McCann et al. | |
| 8,956,586 | B2 | 2/2015 | Ephshteyn et al. | |
| 2005/0123639 | A1 * | 6/2005 | Ring | B21D 39/04 425/392 |

FOREIGN PATENT DOCUMENTS

JP 57074334 A * 5/1982

OTHER PUBLICATIONS

Molydag 254N Product Data Sheet, Distributed by Ladd Research, Williston, VT, https://www.laddresearch.com (accessed May 2015).
Bonderite S-FN M 254N Functional Preventative Coating Acheson known as Molydag 254N Safety Data Sheet, Henkel Corporation, Issued Oct. 21, 2014.

* cited by examiner

*Primary Examiner* — Taiwo Oladapo
(74) *Attorney, Agent, or Firm* — John P. Darling

(57) ABSTRACT

A composition includes molybdenum disulfide, epoxy binder, and 0.01 to 3 wt % lead. The composition is useful, for example, as dry film lubricant.

19 Claims, 5 Drawing Sheets

LOW-LEAD DRY FILM LUBRICANT COMPOSITION

BACKGROUND

Figure 1:
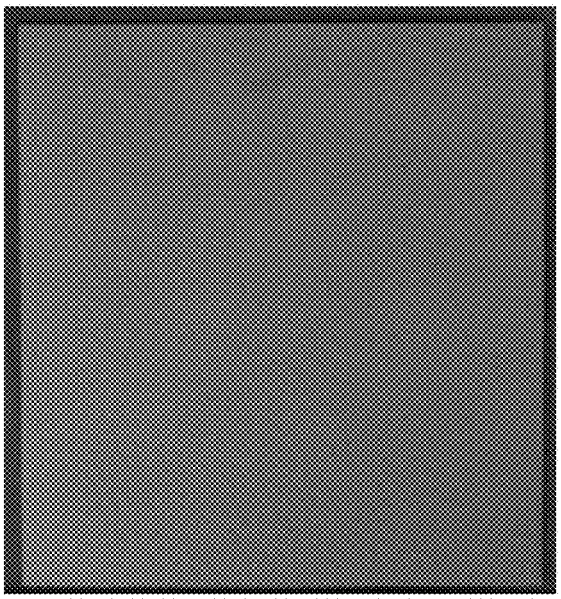

Dry-film lubricants (compositions) are beneficial in various applications, due, in part, to their ability to lower the coefficient of friction.

Historically, dry-film lubricants have typically comprised lead, the use of which, over time, has been limited or banned as dangerous and/or environmentally unfriendly in many countries. Thus, focus within the industry has been directed to developing and adopting lead-free compositions and surface treatments to replace prior art lead-comprising compositions. For example, lead-free dry film lubricant compositions are described in U.S. Pat. No. 7,516,547.

BRIEF DESCRIPTION

Briefly, the present technology satisfies a need for new and improved dry-film lubricant compositions. The present technology may address one or more of the problems and deficiencies of the art discussed above. However, it is contemplated that the technology may prove useful in addressing other problems and deficiencies in a number of technical areas. Therefore, the claimed inventions should not necessarily be construed as limited to addressing any of the particular problems or deficiencies discussed herein.

Certain embodiments of the presently-disclosed compositions and articles comprising and methods using the same, have several features, no single one of which is solely responsible for their desirable attributes. Without limiting the scope of the compositions, articles, and methods as defined by the claims that follow, their features will now be discussed briefly. After considering this discussion, and particularly after reading the section of this specification entitled "Detailed Description" one will understand how the features of the various embodiments disclosed herein provide a number of advantages over the current state of the art. These advantages may include, without limitation, providing safer (e.g., lower lead content) compositions, providing more environmentally-friendly compositions, providing improved lubrication and/or corrosion resistance to substrates, improving adhesion, lowering coefficient of friction, providing surface protection, and/or helping to increase the life expectancy of substrates (e.g., turbine components or parts thereof) or surface integrity thereof. Another desirable attribute is increased temperature range, with higher temperatures facilitated with antimony oxide and/or graphite.

In one aspect, the technology provides a composition comprising:

molybdenum disulfide;

epoxy binder; and lead.

In a second aspect, the technology provides an article comprising a substrate, wherein the substrate comprises, on a surface thereof, a coating comprising the composition.

In a third aspect, the technology provides a method for processing a substrate, the method comprising applying to the substrate a coating comprising the composition, and thereafter curing the coating, thereby forming a cured coating.

In a fourth aspect, the technology provides a method for enhancing the surface durability of an article, the method comprising applying to a surface of the article a coating comprising the composition, and thereafter curing the coating, thereby forming a cured coating on the surface of the article.

These and other features, aspects, and advantages of the present technology will become better understood when the following detailed description is read with reference to the accompanying non-limiting examples and drawings.

DRAWINGS

The present technology will hereinafter be described in conjunction with the following drawing figures.

FIG. 1 is a photograph of an approximately 3 inch×3 inch Marage 250 steel sample that is coated with a uniform coating of a composition according to an embodiment of the technology.

Figure 2A:
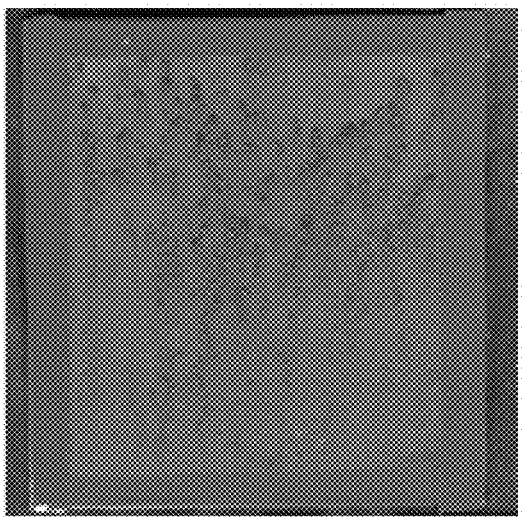
Figure 2B:
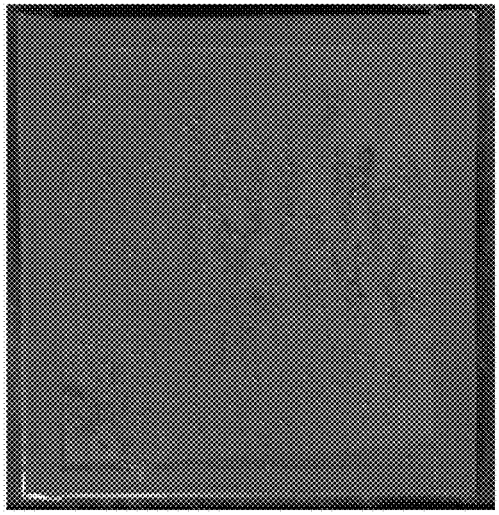
Figure 2C:
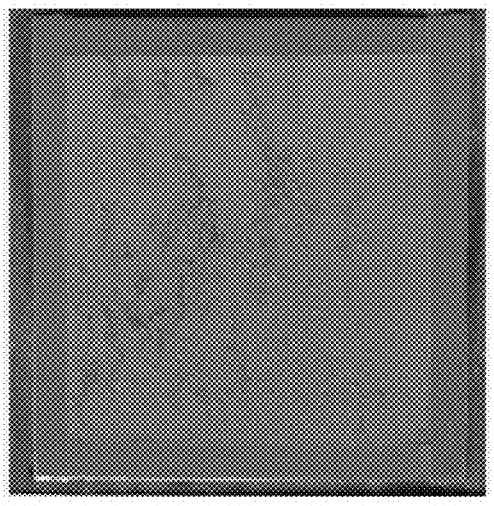

FIGS. 2A-C are photographs of approximately 3 inch×3 inch Marage 250 steel samples coated with a uniform coating of a lead-free dry lubricant composition, following sample failure during a Salt (Fog) Spray Test.

Figure 3A:
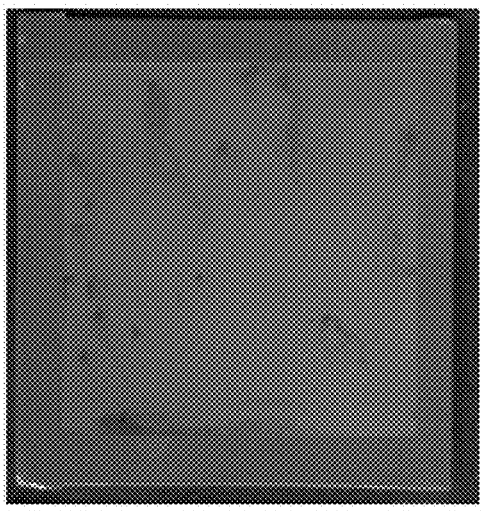
Figure 3B:
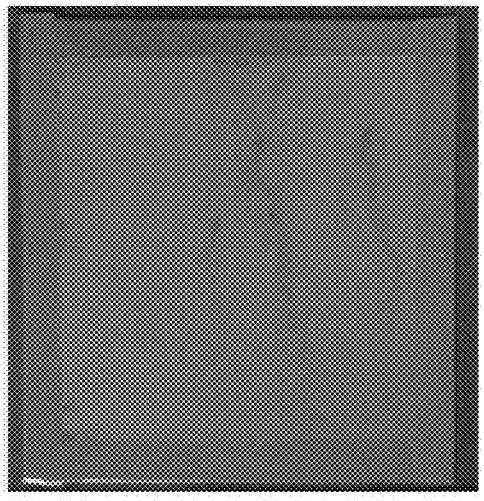
Figure 3C:
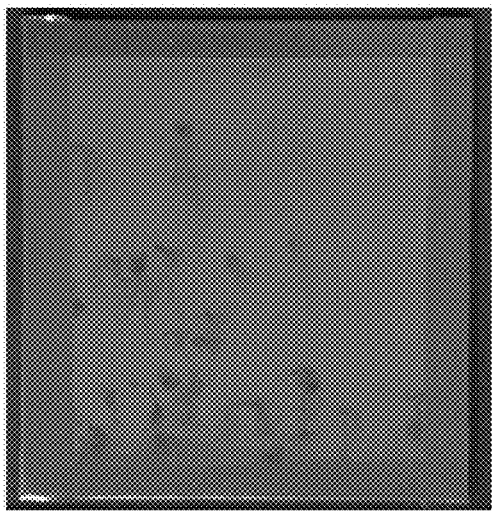

FIGS. 3A-C are photographs of approximately 3 inch×3 inch Marage 250 steel samples coated with a uniform coating of a composition according to an embodiment of the technology, following sample failure during a Salt (Fog) Spray Test.

Figure 4A:
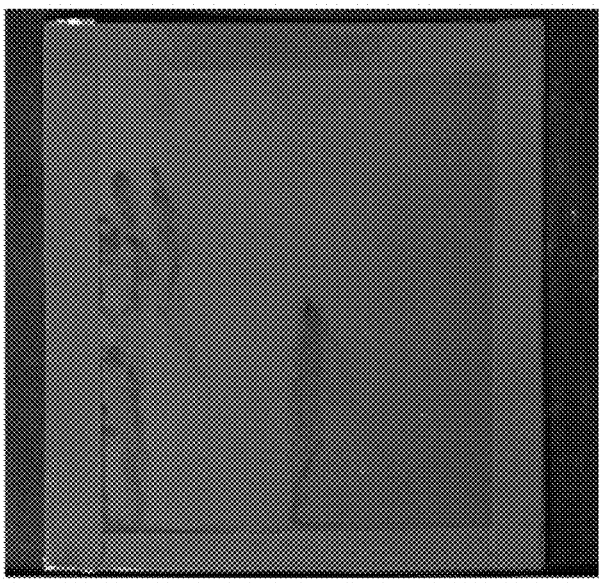
Figure 4B:
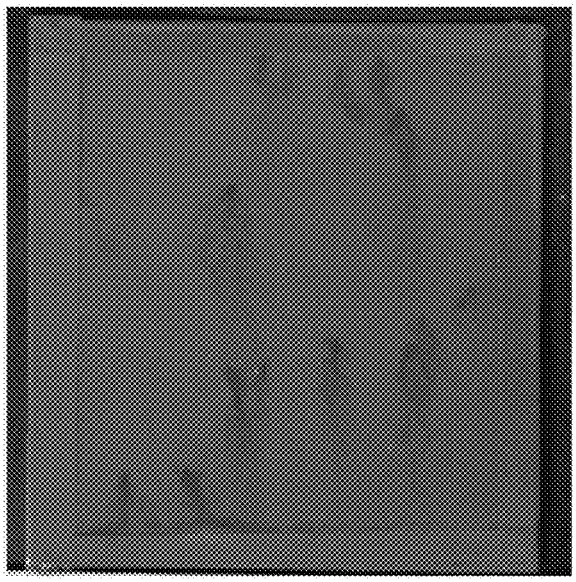

FIGS. 4A-B are photographs of approximately 3 inch×3 inch Marage 250 steel samples coated with a uniform coating of a composition according to an embodiment of the technology, following sample failure during a Salt (Fog) Spray Test.

Figure 5A:
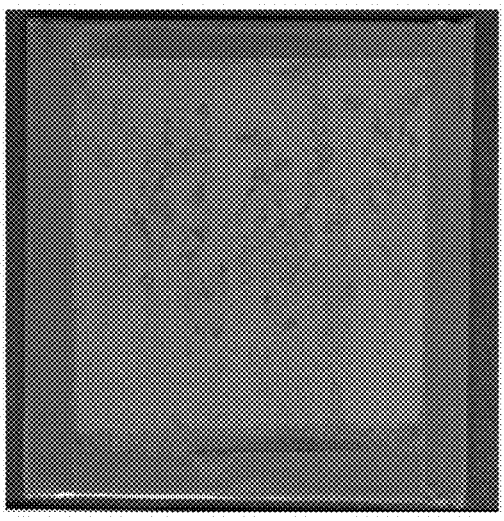
Figure 5B:
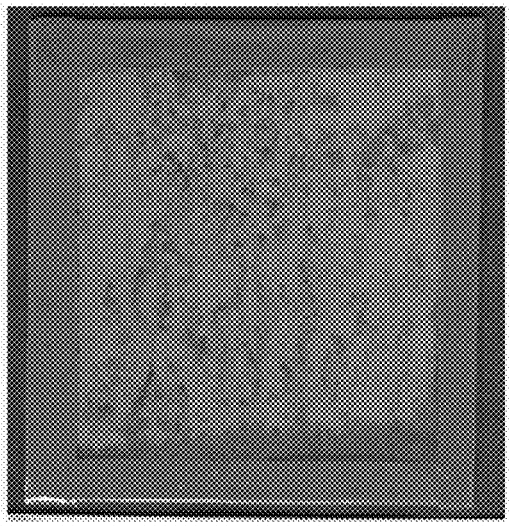
Figure 5C:
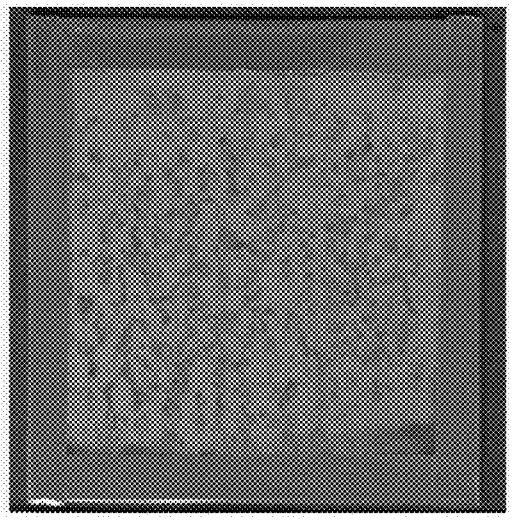

FIGS. 5A-C are photographs of approximately 3 inch×3 inch Marage 250 steel samples coated with a uniform coating of a 6% lead dry lubricant composition, following sample failure during a Salt (Fog) Spray Test.

DETAILED DESCRIPTION

Aspects of the present technology and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the technology in detail. It should be understood, however, that the detailed description and the specific examples, while indicating embodiments of the technology, are given by way of illustration only, and are not by way of limitation. Various substitutions, modifications, additions and/or arrangements within the spirit and/or scope of the underlying inventive concepts will be apparent to those skilled in the art from this disclosure.

In one aspect, the technology provides a composition comprising:

molybdenum disulfide;

epoxy binder; and 0.01 to 3 wt % lead.

The molybdenum disulfide in the composition serves as a lubricant.

The amount of molybdenum disulfide in the composition may vary, depending on desired application. In some embodiments, the composition comprises 2 to 30 wt % molybdenum disulfide (e.g., 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 16, 17, 18, 19, 20, 21, 22, 23, 24, 25, 26, 27, 28, 29, or 30 wt %), including any and all ranges and subranges therein (e.g., 15-25 wt %).

In some embodiments, the composition comprises one or more lubricants in addition to the molybdenum disulfide.

The epoxy binder serves to agglomerate, or otherwise hold together the constituents of the composition.

The amount of epoxy binder in the composition may vary, depending on desired application. In some embodiments, the composition comprises 5 to 50 wt % epoxy binder (e.g., 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 wt %), including any and all ranges and subranges therein (e.g., 10-30 wt %).

Various epoxy resins may be used as the epoxy binder in the composition. For example, in some embodiments, the epoxy binder comprises a bisphenol A epoxy resin. Such resins may be formed by reacting epichlorohydrin with bisphenol A to form diglycidyl ethers of bisphenol A. Accordingly, in certain embodiments, the icomposition comprises bisphenol A diglycidyl ether.

In some embodiments, the epoxy binder comprises one or more of bisphenol A epoxy resin, bisphenol F epoxy resin, bisphenol S epoxy resin, novolac epoxy resin, aliphatic epoxy resin (e.g., glycidyl epoxy resin or cycloaliphatic epoxide), and glycidylamine epoxy resin.

In some embodiments, the epoxy binder has a molecular weight of 250 to 450 g/mol (e.g., 250, 260, 270, 280, 290, 300, 310, 320, 330, 340, 350, 360, 370, 380, 390, 400, 410, 420, 430, 440, or 450 g/mol), including any and all ranges and subranges therein (e.g., 300 to 400 g/mol).

The composition comprises 0.01 to 3 wt % lead (e.g., 0.01, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, 0.50, 0.51, 0.52, 0.53, 0.54, 0.55, 0.56, 0.57, 0.58, 0.59, 0.60, 0.61, 0.62, 0.63, 0.64, 0.65, 0.66, 0.67, 0.68, 0.69, 0.70, 0.71, 0.72, 0.73, 0.74, 0.75, 0.76, 0.77, 0.78, 0.79, 0.80, 0.81, 0.82, 0.83, 0.84, 0.85, 0.86, 0.87, 0.88, 0.89, 0.90, 0.91, 0.92, 0.93, 0.94, 0.95, 0.96, 0.97, 0.98, 0.99, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3.0 wt %), including any and all ranges and subranges therein. Any acceptable source of lead may be used in the composition. For example, in some embodiments, the lead is present via inclusion of lead oxide phosphonate in the composition.

The amount of lead in the composition is lower than that of prior art compositions. For example, Molydag 254N, which is commercially available from Henkel/Acheson, is a dry film lubricant composition, which comprises about 6% lead.

Lead has traditionally been included in dry film lubricant formulations because it has been found to be a very effective inhibitor of corrosion in steels. Owing to recent regulatory constraints, e.g., REACh, lead-free dry film lubricants have been developed to serve as replacements for traditional leaded lubricants. Unfortunately, lead-free dry film lubricant compositions have performed, comparatively, quite poorly as compared to their lead counterparts. For this reason, rather than simply reducing lead, efforts have been directed instead to developing new lead-free formulations with the aspirational intent of achieving, e.g., corrosion resistance, via different mechanisms that do not involve lead. It is thus quite surprising that the reduced lead compositions disclosed herein outperform, by a considerable magnitude, compositions having higher lead levels.

In various embodiments, the components of the composition are mixed together. In some embodiments, the composition comprises a homogenous mixture of the components of the composition (e.g., the molybdenum disulfide, epoxy binder, lead, etc.).

In some embodiments, the composition comprises a liquid (e.g., a solvent), which can serve, in various embodiments, as a carrier medium. For example, in some embodiments, the liquid may comprise one or more of water, an alcohol, a volatile liquid, an organic liquid, etc. In some embodiments, the liquid functions so as to facilitate application of the composition to a substrate. For example, in some embodiments, the liquid allows the composition to be atomized into fine droplets during an applying process (e.g., a spraying process).

In some embodiments, the composition is applied to a substrate in a mixture comprising, e.g., water, and thus the composition, during application, may be "wet." In various embodiments, the application process further comprises, after applying the composition to the substrate, curing at elevated temperature. In embodiments where the composition is wet during application, the curing drives off water, thereby resulting in the application of a dry-film lubricant coating comprising the composition.

In various embodiments, the final dry-film lubricant coating that is disposed on (e.g., directly on) a substrate is, or comprises, the composition.

In particular non-limiting embodiments, the composition comprises at least one solvent selected from the group consisting of water, methyl ethyl ketone, toluene, and propyleneglycol monomethyl ether acetate.

In some embodiments, the composition has a solids content of 20 to 85 wt % (e.g., 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, or 85 wt %), including any and all ranges and subranges therein (e.g., 40-70 wt %, 50-60 wt %, etc.).

In some embodiments, the composition is applied as-is, whereas in other embodiments, the composition is diluted (e.g., with solvent) to facilitate a desired method of application.

In some embodiments, the composition additionally comprises one or more further constituents (e.g., additives). For example, in some embodiments, the composition additionally comprises antimony trioxide and/or graphite.

The composition may be applied (e.g., coated) on a substrate in any method. For example, in some embodiments, the composition is sprayed or brushed onto a surface of a substrate.

A wide array of applications benefit from the composition. For example, the composition may be advantageously applied on one or more substrates such as aviation (e.g., engine) components. Non-limiting examples of substrates upon which the composition is coated, in certain non-limiting embodiments, are provided in Table I.

TABLE I

| Parts | Alloys | Thickness |
|---|---|---|
| Bearing | IN718, 17-4PH, A286, Stellite 6 | .0002-.0005 |
| Blade | Ti64/811 | .001-.003 |
| Bushing | IN718, L605 | Spec |
| Clamp | IN718 | Spec |
| Clevis | IN718 | 0.0005 to 0.0010 |
| Crankshaft | IN718 | 0.0005 to 0.0010 |
| Air Duct | Ti64, A286 | .001-.003 |
| Link | 17-4PH, 51440C | Spec |
| Mount | Ti64 | Spec |
| Nut | 17-4, 15-5, Marage 250, AISI 4340, IN718, AISI 410 SS | Spec |
| Pin | 17-4, IN718 | .0005-.001 |
| Retainer | IN718 | .0005-.001 |
| Seal | 15-5, A286, 410 SS | .0002-.0005, .003 |
| Shaft | Ti64, Ti17, IN718 | .0007-.002 |
| Shim | IN718 | Spec |
| Spacer | Ti64, IN718 | Spec |
| Spinner | AL 6061 | Spec |
| Spool | IN718 | Spec |
| Support | 15-5 | Spec |
| Turnbuckle Body | 17-4PH | Spec |

In a second aspect, the technology provides an article comprising a substrate, wherein the substrate comprises, on a surface thereof, a coating comprising the composition.

In some embodiments, the coating has a thickness of 0.0001 to 0.02 inches (e.g., 0.0001, 0.0005, 0.001, 0.0015, 0.002, 0.0025, 0.003, 0.0035, 0.004, 0.0045, 0.005, 0.0055, 0.006, 0.0065, 0.007, 0.0075, 0.008, 0.0085, 0.009, 0.0095, 0.01, 0.015, or 0.02 inches), including any and all ranges and subranges therein (e.g., 0.0004 to 0.002 inches, 0.0001 to 0.003 inches, 0.001 to 0.003 inches, etc.).

In some embodiments, the substrate comprises one or more materials selected from steel, stainless steel, aluminum, and copper alloy.

In some embodiments, the substrate is an aviation component or a portion (e.g., a surface) thereof. For example, in some embodiments, the substrate is a component listed in Table I above, or a portion thereof.

In a third aspect, the technology provides a method for processing a substrate, the method comprising applying to the substrate a coating comprising the composition, and thereafter curing the coating, thereby forming a cured coating.

The composition may be applied to the substrate in any manner. For example, the composition or a diluted form thereof is applied to the substrate by spraying, dipping, dip-spinning, or brushing onto a substrate. In some embodiments, e.g., spraying, external atomizing type spray guns may be employed.

In non-limiting embodiments, curing is performed for about an hour (60 minutes) at about 275 to 450 ° F., including any and all ranges and subranges therein (e.g., 300-400 ° F.).

In a fourth aspect, the technology provides a method for enhancing the surface durability of an article, the method comprising applying to a surface of the article a coating comprising the composition, and thereafter curing the coating, thereby forming a cured coating on the surface of the article.

EXAMPLES

Certain non-limiting embodiments of the technology are described in the following examples.

Corrosion Testing

Sample preparation. Approximately 3×3 inch Marage 250 steel samples/substrates, representative of, inter alia, turbine engine shafts, were provided. The samples were grit-blasted with 220 mesh aluminum oxide, then cleaned ultrasonically in detergent.

Dry-film lubricant compositions were spray-coated onto the samples in uniform coatings having a thickness of approximately 0.3-10 mils (0.0003-0.01 inches) by means of an airbrush. The compositions comprised liquids/solvents that facilitated spraying.

FIG. 1 is a photograph of one of the steel samples after it was coated with a composition according to an embodiment of the technology. The photograph shown in FIG. 1 is representative of all of the samples, prior to salt (fog) spray testing.

The coating compositions that were spray-coated onto the samples consisted of the same materials (including molybdenum disulfide, epoxy binder (Phosphoric acid, polymer with 4,4'-Isopropylidendiphenol and 2,2'-[(1-methylethylidene)bis(4,1-phenyleneoxymethylene)]bisoxirane)), antimony trioxide, and lead), but differed in amount of lead that they contained. More specifically, commercially-available Molydag 254N, comprising 6% lead, was coated onto the samples for examples 10, 11, and 12. An identical composition, but lead free, was coated onto examples 1, 2, and 3. The coating compositions for examples 4-9, which correspond to embodiments of the technology, were prepared by mixing Molydag 254N with the Pb-free version thereof, so as to achieve compositions having the lead content indicated in Table II below. The coatings were then sprayed onto the samples as described above.

After spray-coating the samples, the coatings were air-dried at room temperature, then were cured at 350 ° F. for one hour.

Salt (Fog) Spray Testing. After the samples were prepared, salt (fog) spray testing was carried out in accordance with Standard Test Method ASTM B117. The test provides a controlled corrosive environment which has been utilized to produce relative corrosion resistance information for specimens of metals and coated metals exposed in a given test chamber.

In accordance with the standard method, samples were placed in a plastic fog chamber, and were subjected to an ultrasonic atomizer that produces a mist of salt droplets (fog). The samples were checked periodically, and the points of initial rust (the point at which rust was first noted) and failure (the point at which it was noted that the cured lubricant film applied to the steel sample showed more than 3 rust spots per panel, or had spots greater than 1 mm in diameter after 100 hours) were recorded.

Results. Results from the salt (fog) spray testing are provided in Table II.

TABLE II

| Example # | Coating Description | Initial Rust (Hours on Test) | Failure (Hours on Test) |
|---|---|---|---|
| 1 | Molybdenum disulfide epoxy resin, 0% Pb | 23.5 | 187 |
| 2 | Molybdenum disulfide epoxy resin, 0% Pb | 23.5 | 187 |
| 3 | Molybdenum disulfide epoxy resin, 0% Pb | 23.5 | 187 |
| 4* | Molybdenum disulfide epoxy resin, 0.06% Pb | 308 | 763 |

TABLE II-continued

| Example # | Coating Description | Initial Rust (Hours on Test) | Failure (Hours on Test) |
|---|---|---|---|
| 5* | Molybdenum disulfide epoxy resin, 0.06% Pb | 308 | 763 |
| 6* | Molybdenum disulfide epoxy resin, 0.06% Pb | 308 | 763 |
| 7* | Molybdenum disulfide epoxy resin, 0.6% Pb | 96 | 932 |
| 8* | Molybdenum disulfide epoxy resin, 0.6% Pb | 96 | 932 |
| 9* | Molybdenum disulfide epoxy resin, 0.6% Pb | 96 | 932 |
| 10 | Molybdenum disulfide epoxy resin, 6% Pb | 96 | 308 |
| 11 | Molybdenum disulfide epoxy resin, 6% Pb | 96 | 308 |
| 12 | Molybdenum disulfide epoxy resin, 6% Pb | 96 | 308 |

*indicates a composition according to an embodiment of the technology.

FIGS. 2A-C are photographs of the samples for examples 1-3 shown in Table II above, following sample failure during the Salt (Fog) Spray Test. It is noted that since the composition used in these examples was lead-free, the examples are not embodiments according to the present technology. As noted in Table II and shown in FIGS. 2A-C, considerable rust (indicative of corrosion) was present on the samples after 187 hours.

FIGS. 3A-C are photographs of the samples for examples 4-6 shown in Table II above, following sample failure during the Salt (Fog) Spray Test. The composition used in these examples, which comprised 0.06% lead, is a composition in accordance with an embodiment of the present technology. As noted in Table II and shown in FIGS. 3A-C, considerable rust (indicative of corrosion) was noted on these samples after 763 hours of testing. Thus, the inventive compositions used in examples 4-6 performed much better than the lead-free compositions used in examples 1-3.

FIGS. 4A-B are photographs of the samples for examples 8 and 9 shown in Table II above, following sample failure during the Salt (Fog) Spray Test. The composition used in these examples, and in example 7, which comprised 0.6% lead, is a composition in accordance with an embodiment of the present technology. As noted in Table II and shown in FIGS. 4A-B, considerable rust (indicative of corrosion) was noted on these samples after 932 hours of testing. Thus, the inventive compositions used in examples 7-9 also performed significantly better than the lead-free compositions used in examples 1-3.

FIGS. 5A-C are photographs of the samples for examples 10-12 shown in Table II above, following sample failure during the Salt (Fog) Spray Test. It is noted that since the composition used in these examples (commercially available Molydag 254N) comprised 6% lead, the examples are not embodiments according to the present technology, as the lead content exceeds that of compositions according to Applicant's technology. As noted in Table II and shown in FIGS. 5A-C, considerable rust (indicative of corrosion) was present on the samples after 308 hours.

Based on the performance of the commercially available composition used in examples 10-12 having 6% lead (which had failed by 308 hours of corrosion testing), and the performance of the commercially available composition used in examples 1-3 having 0% lead (which had failed by 187 hours of corrosion testing), a person having ordinary skill in the art would expect a continued decline in corrosion resistance performance as lead is eliminated from the dry film lubricant composition. However, quite to the contrary, Applicants have discovered a low range of lead that is not only safer than the commercially available 6% Pb formulation used in examples 1-3, but that also performs unexpectedly better, notwithstanding the lower lead content. Thus, the present technology provides low-lead compositions that perform unexpectedly better than their counterparts that contain higher amounts of lead.

Table III provides coating thicknesses for the lead free, 0.06%, 0.6%, and 6% lead examples (based on the average thicknesses measured for each of the three examples having the designated composition of lead) following the salt (fog) spray testing described above.

TABLE III

| Description | Initial Rust (Hours on Test) | Failure (Hours on Test) | Minimum Coating Thinkness (μm) | Maximum Coating Thickness (μm) | Average Coating Thickness (μm) | Standard Deviation of Coating Thickness (μm) |
|---|---|---|---|---|---|---|
| Molydag 254N, Pb Free (Examples 1-3) | 23.5 | 187 | 9.46 | 42.5 | 26.46 | 8.44 |
| Molydag 245N, 100% (0.06% Pb) (Examples 4-6) | 308 | 763 | 21.73 | 40.94 | 29.88 | 4.53 |
| Molydag 245N, 100% (0.6% Pb) (Examples 7-9) | 96 | 932 | 25.49 | 52.88 | 39.12 | 6.76 |
| Molydag 245N, 100% (6% Pb) (Examples 10-12) | 96 | 308 | 20.79 | 72.72 | 46.93 | 13.76 |

The data presented in Table III further evidence the superiority of the low-lead formulations according to the present technology as compared to commercially available formulations (e.g., 6% Pb Molydag 254N), and establish that this superiority cannot be attributed to significant differences in thickness.

The terminology used herein is for the purpose of describing particular embodiments only and is not intended to be limiting of the technology. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed composition, device or method.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present technology have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the technology.

The invention claimed is:

1. A composition comprising:

molybdenum disulfide;

epoxy binder, wherein the epoxy binder comprises bisphenol A diglycidyl ether; and 0.01 to 3 wt % lead.

2. The composition according to claim 1, wherein said molybdenum disulfide, epoxy binder, and lead are present in a mixture.

3. The composition according to claim 2, wherein the mixture is a homogenous mixture.

4. The composition according to claim 1, comprising 2-30 wt % of the molybdenum disulfide.

5. The composition according to claim 4, comprising 15-25 wt % of the molybdenum disulfide.

6. The composition according to claim 1, comprising 5-50 wt % of the epoxy binder.

7. The composition according to claim 6, comprising 10-30 wt % of the epoxy binder.

8. The composition according to claim 1, wherein the epoxy binder has a molecular weight of 250 to 450 g/mol.

9. The composition according to claim 1, additionally comprising antimony trioxide.

10. The composition according to claim 1, additionally comprising one or more solvents.

11. The composition according to claim 10, wherein at least one of the one or more solvents is selected from the group consisting of water, methyl ethyl ketone, toluene, and propyleneglycol monomethyl ether acetate.

12. The composition according to claim 1, said composition having a solids content of 40-70 wt %.

13. An article comprising a substrate, wherein the substrate comprises, on a surface thereof, a coating comprising the composition according to claim 1.

14. The article according to claim 13, wherein the substrate comprises one or more materials selected from steel, stainless steel, aluminum, titanium, nickel, cobalt, and copper alloy.

15. A method for processing a substrate, the method comprising applying to the substrate a coating comprising the composition according to claim 1, and thereafter curing the coating, thereby forming a cured coating.

16. The method according to claim 15, wherein the cured coating has a thickness of 0.0001 to 0.003 inches.

17. A method for enhancing the surface durability of an article, the method comprising applying, to a surface of the article a coating comprising the composition according, to claim 1, and thereafter curing the coating, thereby forming a cured coating on the surface of the article.

18. The method according to claim 17, wherein the article is a gas turbine component.

19. The method according to claim 18, wherein the cured coating has a thickness of 0.0001 to 0.003 inches.

* * * * *